US007379046B2

(12) United States Patent
Toriumi et al.

(10) Patent No.: US 7,379,046 B2
(45) Date of Patent: May 27, 2008

(54) DISPLAY DRIVER AND ELECTRO-OPTICAL DEVICE

(75) Inventors: Yuichi Toriumi, Chino (JP); Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 827 days.

(21) Appl. No.: 10/790,059

(22) Filed: Mar. 2, 2004

(65) Prior Publication Data

US 2004/0227744 A1 Nov. 18, 2004

(30) Foreign Application Priority Data

Mar. 4, 2003 (JP) ..... 2003-056698

(51) Int. Cl.
*G09G 3/36* (2006.01)
*G09G 5/00* (2006.01)

(52) U.S. Cl. ..... 345/100; 345/213

(58) Field of Classification Search ..... 345/87–104, 345/211–213, 55–111
See application file for complete search history.

(56) References Cited

U.S. PATENT DOCUMENTS 5,307,085 A * 4/1994 Nakamura ..... 345/99
5,801,674 A * 9/1998 Shimizu ..... 345/103
6,130,657 A * 10/2000 Kurokawa et al. ..... 345/100
6,137,466 A * 10/2000 Moughanni et al. ..... 345/99
6,229,513 B1 * 5/2001 Nakano et al. ..... 345/99
6,489,942 B1 * 12/2002 Chiba ..... 345/98
6,529,181 B2 * 3/2003 Nakano et al. ..... 345/98
6,778,169 B1 * 8/2004 Hiraga et al. ..... 345/213
6,870,541 B2 * 3/2005 Yamamoto et al. ..... 345/531
6,933,914 B2 * 8/2005 Kanzaki et al. ..... 345/93
7,002,568 B2 * 2/2006 Morita ..... 345/211
2002/0190973 A1 12/2002 Morita
2002/0190974 A1 12/2002 Morita

FOREIGN PATENT DOCUMENTS

| | | |
|---|---|---|
| JP | A-64-086774 | 3/1989 |
| JP | A-05-341725 | 12/1993 |
| JP | A-11-015451 | 1/1999 |
| JP | A-2000-10527 | 1/2000 |
| JP | A-2000-148080 | 5/2000 |
| JP | A-2000-322017 | 11/2000 |
| JP | A-2001-092424 | 4/2001 |

OTHER PUBLICATIONS

U.S. Appl. No. 10/834,036, filed Apr. 29, 2004, Morita et al.
U.S. Appl. No. 10/833,996, filed Apr. 29, 2004, Morita et al.
U.S. Appl. No. 10/790,692, filed Mar. 3, 2004, Toriumi et al.
U.S. Appl. No. 10/792,819, filed Mar. 5, 2004, Toriumi et al.
U.S. Appl. No. 10/790,869, filed Mar. 3, 2004, Toriumi et al.
U.S. Appl. No. 10/790,806, filed Mar. 3, 2004, Toriumi et al.

* cited by examiner

*Primary Examiner*—Richard A. Hjerpe
*Assistant Examiner*—M. Fatahiyar
(74) *Attorney, Agent, or Firm*—Oliff & Berridge, PLC

(57) ABSTRACT

A display driver includes an instruction signal generation circuit which generates a data-fetch-start-instruction-signal; a data latch which fetches display data at data fetch timings including a fetch start timing that is determined by the data-fetch-start-instruction-signal; and a data line drive circuit which drives the data lines, based on the display data fetched into the data latch. The instruction signal generation circuit includes a fetch-start-timing-setting-register into which is set data for determining the fetch start timing of the display data, and the instruction signal generation circuit generates the data-fetch-start-instruction-signal that changes when a period corresponding to the data set in the fetch-start-timing-setting-register has elapsed, with reference to a reference timing.

14 Claims, 13 Drawing Sheets

DISPLAY DRIVER AND ELECTRO-OPTICAL DEVICE

Japanese Patent Application No. 2003-56698, filed on Mar. 4, 2003, is hereby incorporated by reference in its entirety.

BACKGROUND OF THE INVENTION

The present invention relates to a display driver and a display device.

A display panel exemplified by a liquid-crystal display (LCD) panel is used in a display device that forms a display section of various types of information device. This display device comprises the display panel, a scan driver for driving a plurality of scan lines of the display panel, and a signal driver for driving a plurality of data lines of the display panel (generally speaking: a display driver).

BRIEF SUMMARY OF THE INVENTION

According to one aspect of the present invention, there is provided a display driver which drives a plurality of data lines of an electro-optical device that includes a plurality of pixels, a plurality of scan lines, and the data lines, the display driver comprising:

an instruction signal generation circuit which generates a data-fetch-start-instruction-signal;

a data latch which fetches display data at data fetch timings including a fetch start timing that is determined by the data-fetch-start-instruction-signal; and a data line drive circuit which drives the data lines, based on the display data fetched into the data latch, wherein the instruction signal generation circuit includes a fetch-start-timing-setting-register into which is set data for determining the fetch start timing of the display data, and wherein the instruction signal generation circuit generates the data-fetch-start-instruction-signal that changes when a period corresponding to the data set in the fetch-start-timing-setting-register has elapsed, with reference to a reference timing.

According to another aspect of the present invention, there is provided an electro-optical device comprising:

a plurality of pixels;

a plurality of scan lines;

a plurality of data lines; and the above described display driver, which drives the data lines.

DETAILED DESCRIPTION OF THE EMBODIMENT

Embodiments of the present invention are described below. Note that the embodiments described below do not limit the scope of the invention defined by the claims laid out herein. Similarly, the overall configuration of the embodiments below should not be taken as limiting the subject matter defined by the claims herein.

A signal driver is supplied with display data from a controller (display controller) that controls a scan driver and a signal driver in accordance with instructions from a host such as a central processing unit (CPU). The signal driver outputs a drive signal corresponding to that display data to a data line. During this time, the signal driver starts the fetch of display data from the controller at a fetch start timing that is determined by an enable input signal EI from the controller.

However, this signal driver cannot be connected to a controller that does not output the enable input signal EI. The signal driver is one of the devices configuring the above described display device, and it is desirable that it can also be connected to a controller that does not output the enable input signal EI, to enable installation of the display device in as many information devices as possible.

The embodiments described below make it possible to provide a display driver that can generate a signal for regulating the display data fetch start timing internally, and a display system provided with that display driver.

These embodiments are described below with reference to the accompanying figures.

1. Display Device

Figure 1:
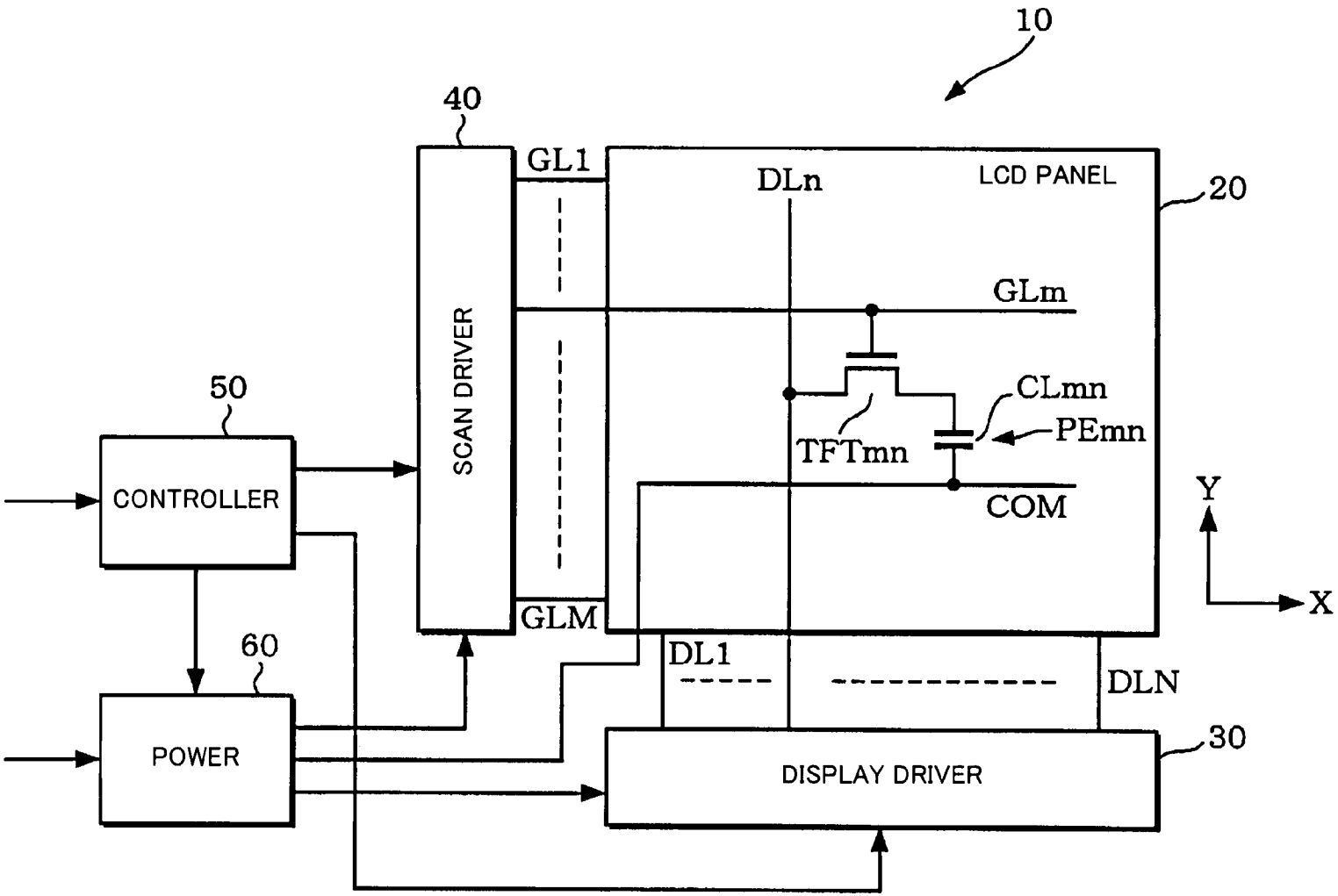
FIG. 1 is a schematic block diagram of the configuration of a display device.

An outline of the configuration of a display device is shown in FIG. 1. In this case, an outline of the configuration of a liquid-crystal device is shown by way of example. The liquid-crystal device could be incorporated in any of a variety of electronic appliances, such as a mobile phone, a portable information device (such as a PDA), a digital camera, a projector, a portable audio player, a mass-storage device, a video camera, an electronic organizer, or a global positioning system (GPS) device.

In FIG. 1, a liquid-crystal device 10 comprises a liquid-crystal panel (generally speaking: a display panel) 20, a display driver (source driver) 30, a scan driver (gate driver) 40, a controller (display controller) 50, and a power circuit 60. The liquid-crystal device 10 can also be called an electro-optical device.

Note that not all of these circuit blocks are essential for the liquid-crystal device 10; it is also possible to have a configuration that omits some of these components.

The LCD panel 20 comprises a plurality of scan lines (gate lines), a plurality of data lines (source lines), and a plurality of pixels, the scan lines (gate lines) being provided in rows, the data lines (source lines) being provided in columns and intersecting the scan lines, each of the pixels being specified by one of the scan lines and one of the data lines. Each pixel comprises a thin-film transistor (hereinafter abbreviated to TFT) and a pixel electrode. The TFT is connected to the data line and the pixel electrode is connected to that TFT.

More specifically, the liquid-crystal panel 20 is formed on a panel substrate such as a glass substrate, by way of example. Disposed on the panel substrate are scan lines GL1 to GLM (where M is an integer greater than or equal to two), which are disposed in the Y direction in FIG. 1 in a plurality of lines each extending in the X direction, and data lines DL1 to DLN (where N is an integer greater than or equal to two), which are disposed in the X direction in a plurality of lines each extending in the Y direction. A pixel PEmn is provided at a position corresponding to the intersection between a scan line GLm (where m is an integer such that $1 \leqq m \leqq M$) and a data line DLn (where n is an integer such that $1 \leqq n \leqq N$). The pixel PEmn comprises a TFTmn and a pixel electrode.

The gate electrode of TFTmn is connected to the scan line GLm. The source electrode of TFTmn is connected to the data line DLn. The drain electrode of TFTmn is connected to the pixel electrode. A liquid-crystal capacitance CLmn is generated between the pixel electrode and an opposing electrode COM (common electrode) that faces that pixel electrode with a liquid-crystal element (generally speaking: an electro-optical material) therebetween. Note that the configuration could be such that a holding capacitance is formed in parallel with the liquid-crystal capacitance CLmn. The transmissivity of the pixel varies with the voltage applied between the pixel electrode and the opposing electrode COM. A voltage VCOM supplied to the opposing electrode COM is created by the power circuit 60.

The thus-configured LCD panel 20 is formed by pasting together a first substrate on which is formed the pixel electrode and TFT and a second substrate on which is formed the opposing electrode, with a liquid crystal acting as an electro-optical material inserted between the two substrates, by way of example.

The display driver 30 drives the data lines DL1 to DLN of the LCD panel 20, based on display data for one horizontal scan period. More specifically, the display driver 30 is capable of driving at least one of the data lines DL1 to DLN, based on the display data.

The scan driver 40 scans the scan lines GL1 to GLM of the LCD panel 20. More specifically, the scan driver 40 selects the scan lines GL1 to GLM sequentially within one vertical period, and drives the selected scan lines.

The controller 50 outputs control signals for the display driver 30, the scan driver 40, and the power circuit 60, in accordance with details set by a host such as a CPU that is not shown in the figure. More specifically, the controller 50 supplies the display driver 30 and the scan driver 40 with the setting of the operating mode, an internally generated horizontal synchronization signal, and a vertical synchronization signal. The horizontal synchronization signal determines the horizontal scan period. The vertical synchronization signal determines the vertical scan period. The controller 50 also outputs display data to the display driver 30. Furthermore, the controller 50 controls the timing of polarity inversions of the voltage VCOM of the opposing electrode COM with respect to the power circuit 60, by a polarity inversion signal POL.

The power circuit 60 generates the various voltages used by the LCD panel 20 and the voltage VCOM of the opposing electrode COM, based on a reference voltage supplied from the outside.

Note that FIG. 1 shows a configuration in which the liquid-crystal device 10 comprises the controller 50, but the controller 50 could equally well be provided outside of the liquid-crystal device 10. Alternatively, the configuration could be such that both the controller 50 and the host (not shown in the figure) are comprised within the liquid-crystal device 10. The liquid-crystal device 10 could also be configured to comprise at least the display driver 30 and the LCD panel 20.

At least one of the scan driver 40, the controller 50, and the power circuit 60 could be incorporated into the display driver 30.

Figure 2:
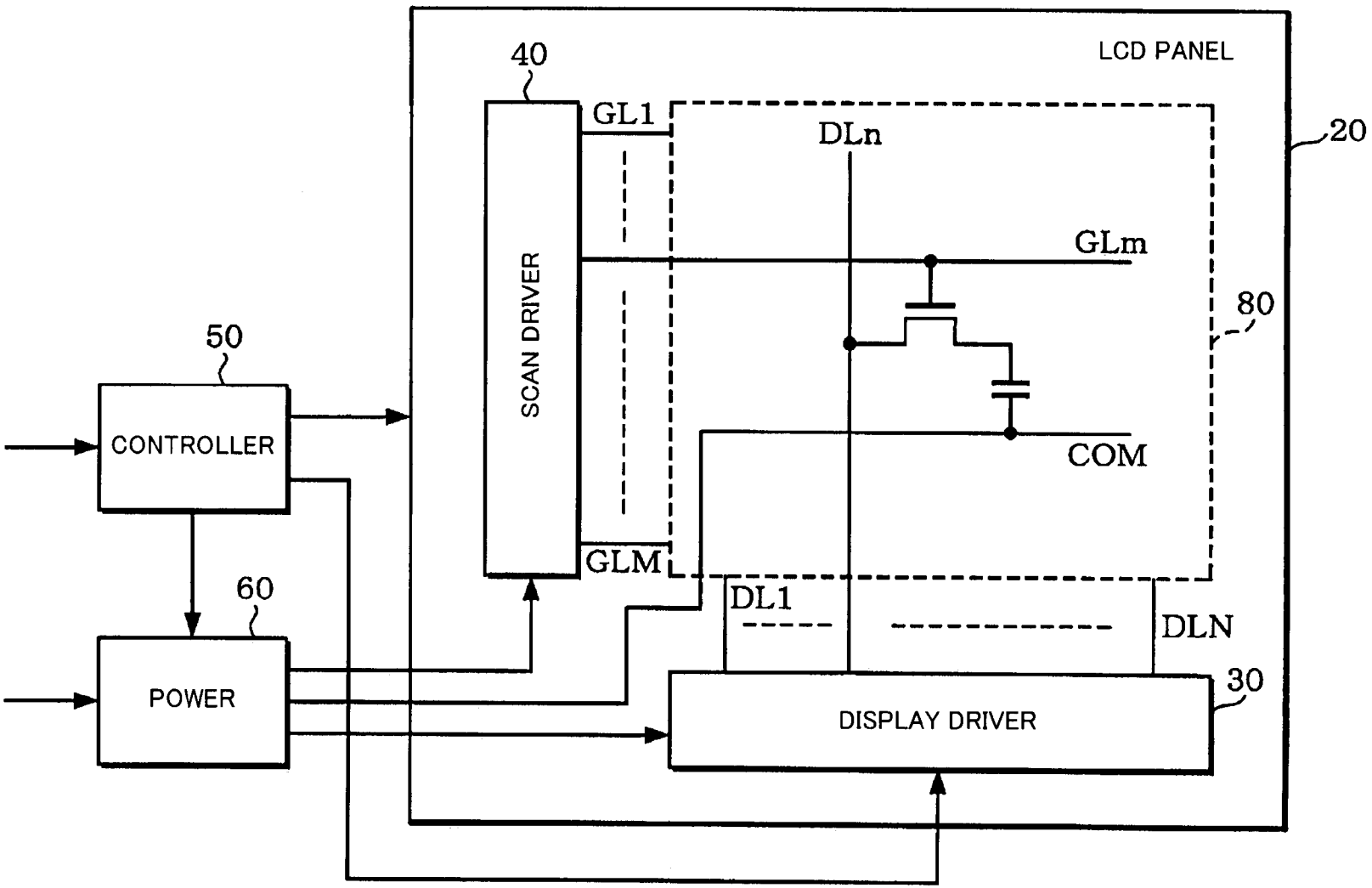
FIG. 2 is a block diagram of an example of the formation of a display driver and scan driver on an LCD panel.

Similarly, some or all of the display driver 30, the scan driver 40, the controller 50, and the power circuit 60 could be formed on the LCD panel 20. In such a case, the LCD panel 20 could be called an electro-optical device. As shown by way of example in FIG. 2, the display driver 30 and the scan driver 40 are formed on the LCD panel 20. This LCD panel 20 could be configured to comprise a plurality of data lines, a plurality of scan lines, a plurality of pixels each specified by one of the plurality of data lines and one of the plurality of scan lines, and a display driver that drives the plurality of data lines. The plurality of pixels are formed in a pixel formation area 80 of the LCD panel 20.

2. Display Driver

Display data is supplied to the display driver from the controller. The display driver fetches the display data at the fetch start timing that is determined by the enable input signal EI from the controller.

Figure 3A:
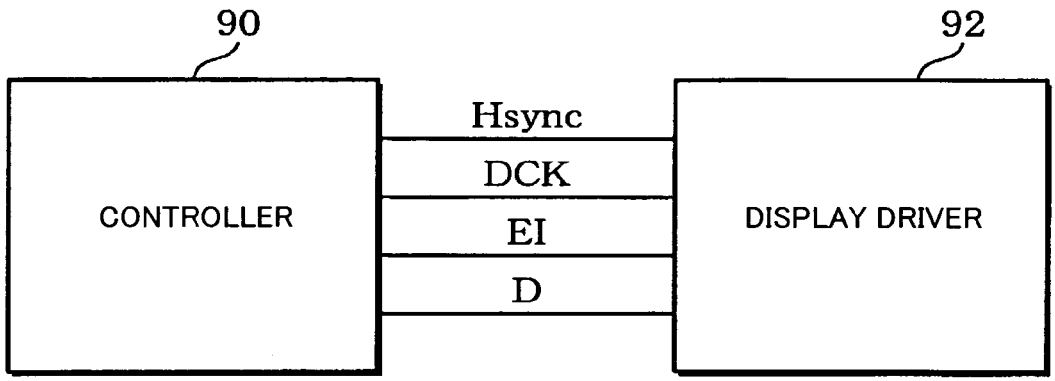
FIG. 3A shows the connective relationship between a display driver of a comparison example and a controller.

The connective relationship between a display driver of a comparative example and the controller is shown in FIG. 3A. An example of the timing of the signals of FIG. 3A is shown in FIG. 3B.

In the comparative example, a controller 90 controls the display timing of a display driver 92 and also supplies display data. The controller 90 outputs a horizontal synchronization signal Hsync, a reference clock DCK, the enable input signal EI; and display data D to the display driver 92.

The horizontal synchronization signal Hsync is a signal that determines the horizontal scan period. The reference clock DCK is a clock for fetching display data for one horizontal scan period. The controller 90 outputs the display data D in synchronization with the reference clock DCK. The enable input signal EI is a signal that determines the fetch start timing for fetching the display data.

Figure 3B:
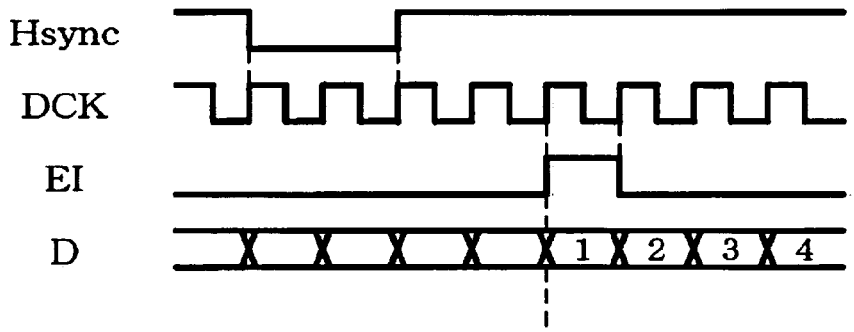
FIG. 3B is a timing chart of an example of the timing of the signals of FIG. 3A.

In FIG. 3B, the controller 90 outputs the reference clock DCK and also causes the enable input signal EI to change after a predetermined number of clocks of the reference clock DCK have elapsed after a change in the horizontal synchronization signal Hsync, to output the initial display data. The controller 90 then outputs the next display data sequentially, to supply display data for one horizontal scan period to the display driver 92.

The display driver 92 sequentially fetches the display data D in synchronization with the reference clock DCK, after the fetch start timing that is determined by the enable input signal EI.

If the controller 90 does not output the enable input signal EI, therefore, the display driver 92 cannot fetch the display data. For that reason, the display driver 92 cannot be connected to such a controller.

With the display driver of the embodiments described below (such as the display driver 30), a data-fetch-start-instruction-signal that determines the fetch start timing is generated internally. For that reason, the display driver controlled by a controller that does not output the enable input signal EI can be provided. It is therefore possible to use this display driver with a wider range of display systems.

2.1 First Embodiment

Figure 4:
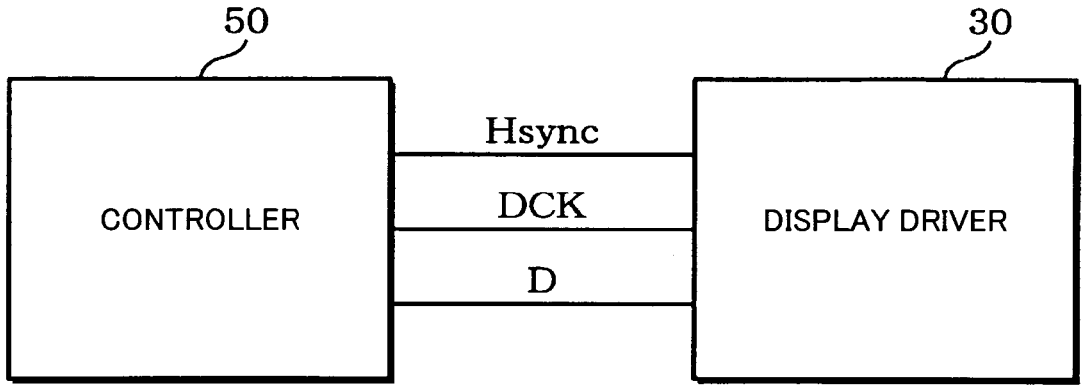
FIG. 4 shows the connective relationship between a display driver of a first embodiment and a controller.

The connective relationship between a display driver of a first embodiment of this invention and a controller is shown in FIG. 4. In this case, signals that are the same as those shown in FIG. 3A are denoted by the same signal names and further description thereof is omitted.

In this first embodiment, the controller 50 outputs the horizontal synchronization signal Hsync, the reference clock DCK, and the display data D to the display driver 30. Unlike as shown in FIG. 3A, the controller 50 does not output the enable input signal EI to the display driver 30. The display driver 30 is capable of internally generating a data-fetch-start-instruction-signal that determines the fetch start timing that is determined by the enable input signal EI in FIG. 3B, based on the horizontal synchronization signal Hsync and the reference clock DCK.

Figure 5:
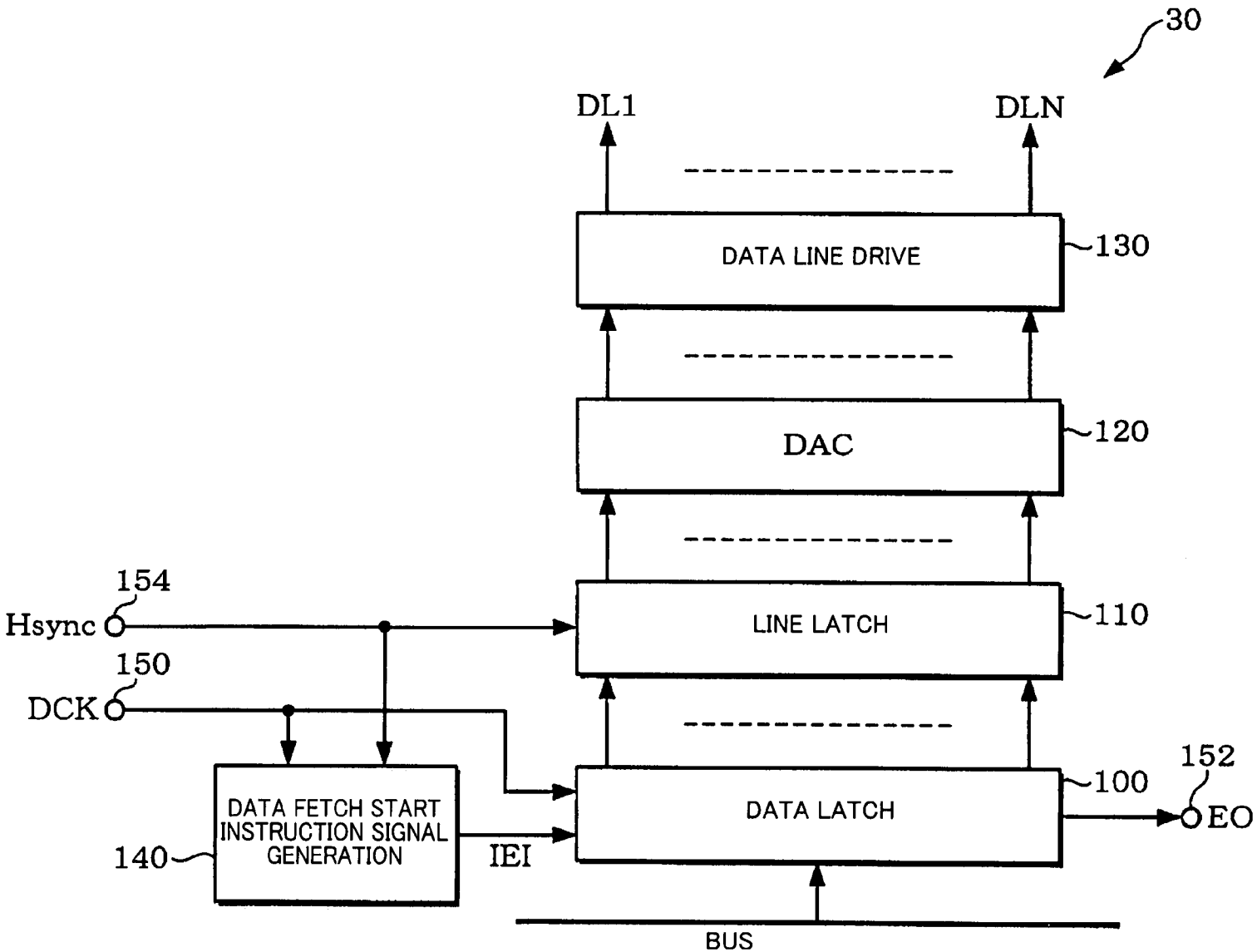
FIG. 5 is a schematic block diagram of the configuration of the display driver of the first embodiment.

A schematic block diagram of the configuration of the display driver 30 is shown in FIG. 5. The display driver 30 comprises a data latch 100, a line latch 110, a digital-to-analog converter (DAC; generally speaking: a voltage select circuit) 120, a data line drive circuit 130, and a data-fetch-start-instruction-signal generation circuit (generally speaking, an instruction signal generation circuit) 140.

The data latch 100 fetches display data for one horizontal scan period.

More specifically, the data latch 100 fetches the display data at data fetch timings including a fetch start timing that is determined by the data-fetch-start-instruction-signal IEI generated by the data-fetch-start-instruction-signal generation circuit 140. Even more specifically, the data latch 100 fetches display data on the bus at data fetch timings including a fetch start timing that is determined by the data-fetch-start-instruction-signal IEI and obtained by shifting the data-fetch-start-instruction-signal IEI by the reference clock DCK. The reference clock DCK is input from the controller 50 through a reference clock input terminal 150, by way of example.

Note that the reference clock DCK that is input to the data latch 100 could be a signal that is a reference clock signal that has been input to the reference clock input terminal 150 and has been subjected to a process such as buffering or phase adjustment, and it can be called a signal corresponding to the reference clock DCK that is input to the reference clock input terminal 150. The display data on the bus could be a signal that is the display data D that has been input from the controller 50 through a data input terminal (not shown in the figure) and has been subjected to a process such as buffering, by way of example, and it can be called a signal corresponding to the display data D.

The data latch 100 also outputs an enable output signal EO through an enable output terminal 152, as an output corresponding to the data-fetch-start-instruction-signal IEI.

The line latch 110 latches the display data that was fetched by the data latch 100, as display data corresponding to the data lines, based on the horizontal synchronization signal Hsync. The horizontal synchronization signal Hsync is input from the controller 50 through a horizontal synchronization signal input terminal 154, by way of example.

Note that the horizontal synchronization signal Hsync that is input to the line latch 110 could be a signal that is the horizontal synchronization signal that has been input to the horizontal synchronization signal input terminal 154 and has been subjected to a process such as buffering or phase adjustment, and it can be called a signal corresponding to the horizontal synchronization signal Hsync that has been input to the horizontal synchronization signal input terminal 154.

The DAC 120 outputs a drive voltage (grayscale voltage) corresponding to the display data from the line latch 110 for each data line, from a plurality of reference voltages such that each reference voltage corresponds to display data. More specifically, the DAC 120 decodes display data from the line latch 110 and selects one of the plurality of reference voltages, based on the result of the decoding. The reference voltage selected by the DAC 120 is output to the data line drive circuit 130 as a drive voltage.

The data line drive circuit 130 drives at least one of the data lines DL1 to DLN, based on the drive voltage from the DAC 120.

The data-fetch-start-instruction-signal generation circuit 140 generates the data-fetch-start-instruction-signal IEI, based on the horizontal synchronization signal Hsync and the reference clock DCK.

Figure 6:
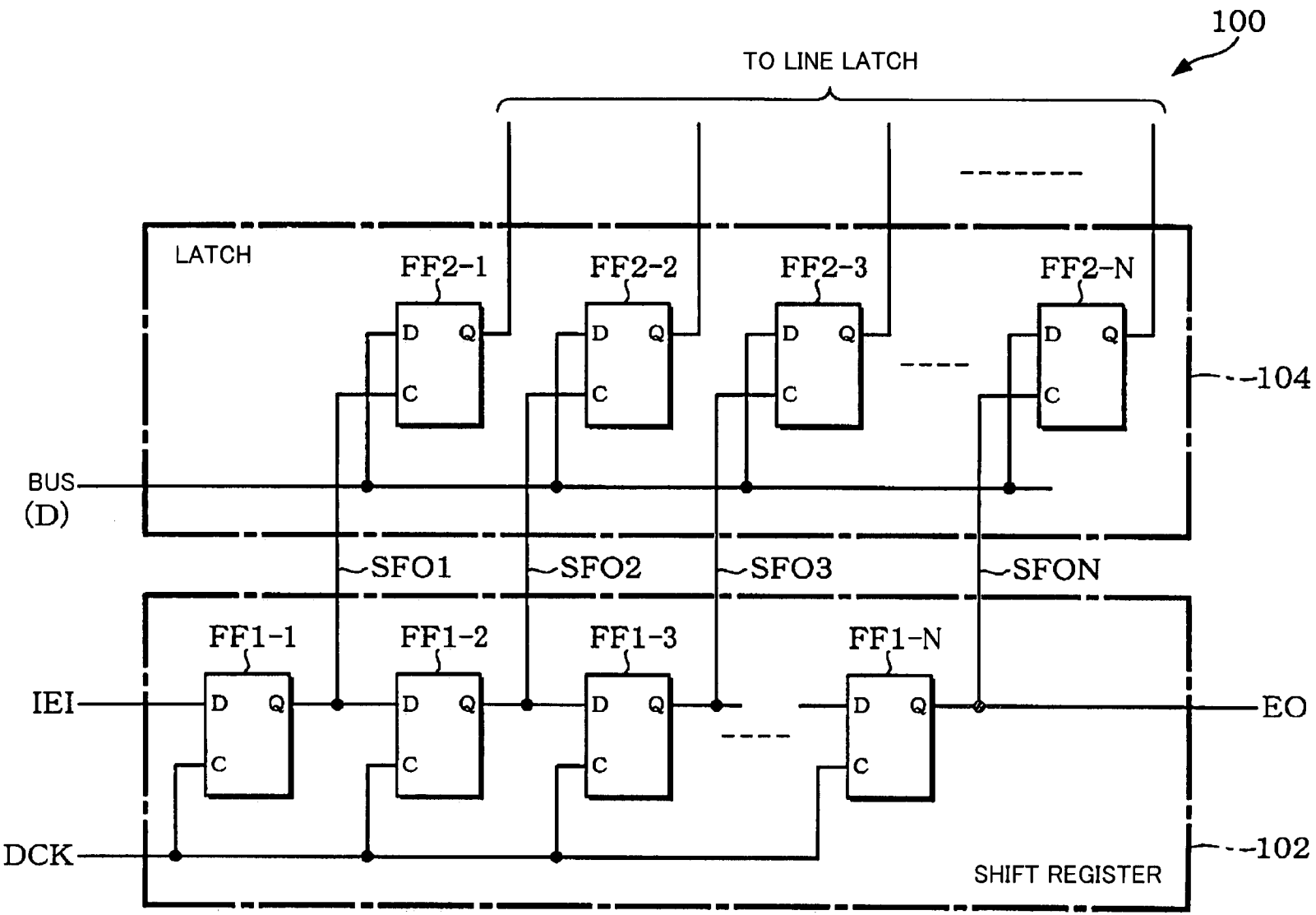
FIG. 6 is a circuit diagram of an example of the configuration of a data latch.

An example of the configuration of the data latch 100 is shown in FIG. 6. The data latch 100 comprises a shift register 102 and a latch 104.

The shift register 102 has a plurality of flip-flops FF1-1 to FF1-N. The shift register 102 shifts the data-fetch-start-instruction-signal, based on the reference clock DCK, and outputs shift outputs SFO1 to SFON (signals for regulating the data fetch timing) from the flip-flops FF1-1 to FF1-N.

More specifically, the flip-flop FF1-i (where i is an integer such that: $1 \leqq i \leqq N$), has a D terminal, a C terminal and a Q terminal. In the flip-flop FF1-i, a signal that is input to the D terminal is held at the edge of an input to the C terminal, and the thus-held signal is output from the Q terminal.

The data-fetch-start-instruction-signal IEI is input to the D terminal of the flip-flop FF1-1. The Q terminal of the flip-flop FF1-j (where j is an integer such that: $1 \leqq j \leqq N-1$) is connected to the D terminal of the flip-flop FF1−(j+1). The enable output signal EO is output from the Q terminal of the flip-flop FF1-N. The reference clock DCK is input in common to the C terminals of the flip-flops FF1-i to FF1-N. The shift outputs SFO1 to SFON are output from the Q terminals of the flip-flops FF1-i to FF1-N.

The latch 104 has a plurality of flip-flops FF2-1 to FF2-N. The latch 104 fetches and holds display data on the bus, based on the shift outputs SFO1 to SFON.

More specifically, a flip-flop FF2-k (where k is an integer such that: $1 \leqq k \leqq N$) has a D terminal, a C terminal and a Q terminal. In the flip-flop FF2-k, a signal that is input to the D terminal is held at the edge of an input to the C terminal, and the thus-held signal is output from the Q terminal.

The D terminals of the flip-flops FF2-1 to FF2-N are connected in common to the bus. The shift output SFOj of the flip-flop FF2-k of the shift register 102 is input to the C terminal of the flip-flop FF2-k.

The fetched and held display data is output from the Q terminals of the flip-flops FF2-1 to FF2-N.

In the thus-configured data latch 100, the shift register 102 first shifts the data-fetch-start-instruction-signal IEI, based on the reference clock DCK, and the enable output signal EO is output from the final-stage flip-flop FF1-N. The shift output that is output from each flip-flop changes sequentially in synchronization with the reference clock DCK. Display data on the bus is fetched by the flip-flops FF2-1 to FF2-N of the latch 104 at the edges of the shift outputs SFO1 to SFON (data fetch timing) that change in sequence.

The fetch start timing of display data is therefore determined by the data-fetch-start-instruction-signal IEI.

Note that shift register connected to the stage after the flip-flop FF1-N of the shift register 102 could be shifted continuously by inputting the enable output signal EO from the display driver 30 (generally speaking: a master display driver) to another display driver (generally speaking: a slave display driver), enabling the driving of an LCD panel having a large number of data lines.

The data-fetch-start-instruction-signal generation circuit 140 that supplies the data-fetch-start-instruction-signal IEI to this data latch 100 has the configuration described below.

Figure 7:
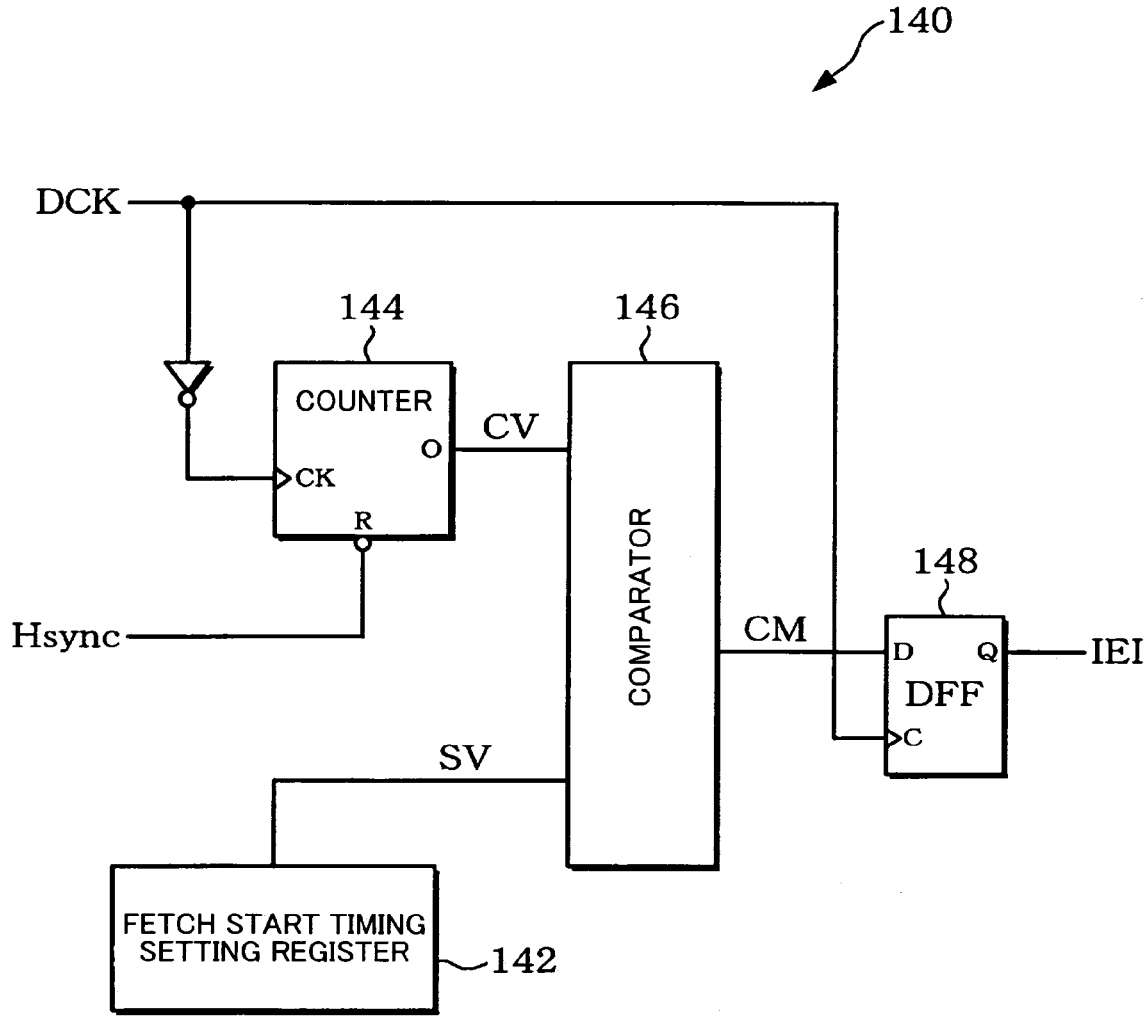
FIG. 7 is a block diagram of an example of the configuration of a data-fetch-start-instruction-signal generation circuit.

An example of the configuration of the data-fetch-start-instruction-signal generation circuit 140 is shown in FIG. 7. The data-fetch-start-instruction-signal generation circuit 140 comprises a fetch-start-timing-setting-register 142, a counter 144, a comparator 146, and a DFF 148.

Data for determining the display data fetch start timing is set in the fetch-start-timing-setting-register 142 by the controller 50 (or a host), by way of example.

The data-fetch-start-instruction-signal generation circuit 140 is capable of generating a data-fetch-start-instruction-signal that changes when a period corresponding to the data set in the fetch-start-timing-setting-register 142 has elapsed, with reference to predetermined reference timing.

The data for determining that fetch start timing could be called data corresponding to the period up until the fetch start timing of the display data, using the transition points of the horizontal synchronization signal Hsync as reference. Even more specifically, data corresponding to the period up until the fetch start timing of the display data can be set to be a number of clocks of the reference clock DCK up until the fetch start timing of the display data, with reference to the transition points of the horizontal synchronization signal Hsync.

One or a plurality of bits of data SV that has been set in the fetch-start-timing-setting-register 142 is input to the comparator 146.

The counter 144 increments (counts up) a count value therein at the rising edge of an input signal to a CK terminal. The counter 144 initializes (sets to zero) the count thereof when an input signal to an R terminal goes low. An inversion of the reference clock DCK is input to the CK terminal of the counter 144. The horizontal synchronization signal Hsync is input to the R terminal of the counter 144. A count CV of the counter 144 is input to the comparator 146.

The thus-configured counter 144 resets the count thereof in accordance with the logic level of the horizontal synchronization signal Hsync and increments that count at the rising edge of the reference clock DCK.

The comparator 146 compares the data SV that has been set in the fetch-start-timing-setting-register 142 and the count CV of the counter 144, and outputs a comparison result signal CM. If the numerical value corresponding to the data SV that is set in the fetch-start-timing-setting-register 142 matches the numerical value of the count CV of the counter 144 in the comparator 146, the comparison result signal CM goes high. If the numerical value corresponding to the data SV that is set in the fetch-start-timing-setting-register 142 does not match the numerical value of the count CV of the counter 144 in the comparator 146, the comparison result signal CM goes low.

The DFF 148 holds the logic level of a signal that is input to a D terminal thereof at the rising edge of a signal that is input to a C terminal thereof, and outputs a signal corresponding to the logic level of the held signal from a Q terminal. The comparison result signal CM from the comparator 146 is input to the D terminal of the DFF 148. The reference clock DCK is input to the C terminal of the DFF 148. The data-fetch-start-instruction-signal IEI is output from the Q terminal of the DFF 148.

With the thus-configured DFF 148, the logic level of the comparison result signal CM is held at the rising edge of the reference clock DCK, and is output as the data-fetch-start-instruction-signal IEI.

Figure 8:
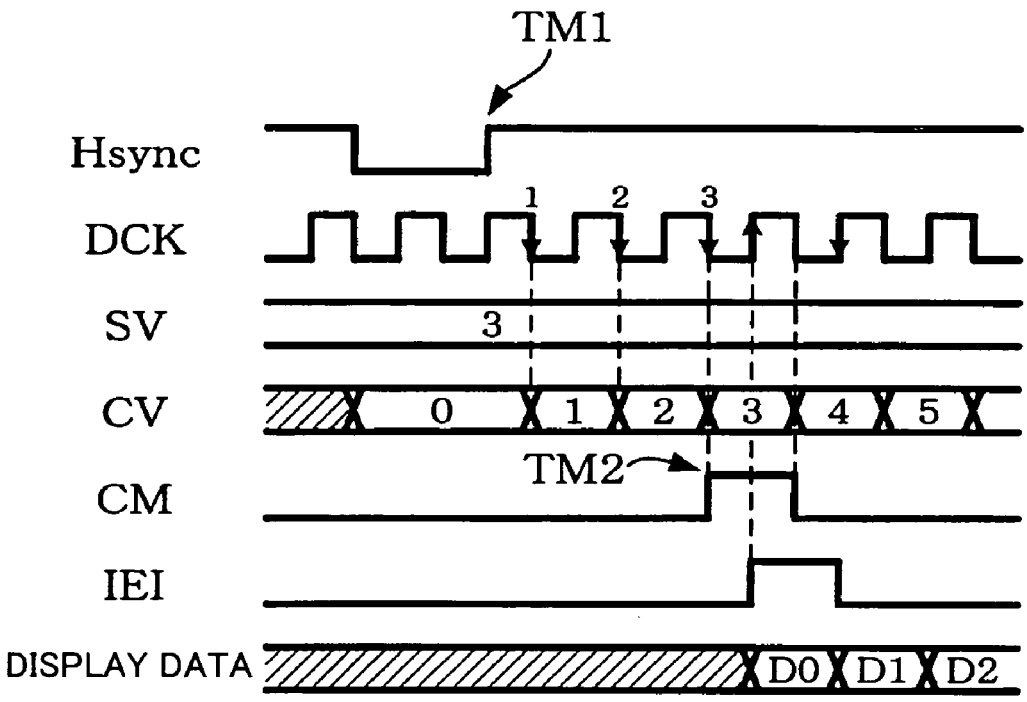
FIG. 8 is a timing chart of an example of the operation of the data-fetch-start-instruction-signal generation circuit.

An example of the operation of the data-fetch-start-instruction-signal generation circuit 140 is shown in FIG. 8. In this case, assume that "3" is set as the data SV in the fetch-start-timing-setting-register 142. In FIG. 8, the data-fetch-start-instruction-signal IEI changes when the number of clocks of the reference clock DCK (counted at the falling edge of the reference clock DCK) reaches "3", with reference to the rising edge of the horizontal synchronization signal Hsync.

The count in the counter 144 is initialized during the period in which the horizontal synchronization signal Hsync is low. When the horizontal synchronization signal Hsync changes to high (at TM1), the counter 144 increments the count CV thereof at the falling edge of the reference clock DCK. The comparator 146 compares the count CV and the data SV that has been set in the fetch-start-timing-setting-register 142, and outputs the comparison result signal CM.

When the count CV reaches "3", the comparison result signal CM of the comparator 146 changes to high (TM2). In the DFF 148, the comparison result signal CM is held at the rising edge of the reference clock DCK. At the next falling edge of the reference clock, the count CV of the counter 144 would become "4", so the data-fetch-start-instruction-signal IEI that is output from the Q terminal of the DFF 148 goes high for just one clock period of the reference clock DCK.

The display data that is input after the data-fetch-start-instruction-signal IEI goes high is fetched by the data latch 100.

FIG. 8 has been described as showing the fetching into the data latch 100 of display data DO that has been supplied in the period during which the data-fetch-start-instruction-signal IEI is high, but the present invention is not limited thereto. The configuration of the data latch 100 could be such that it fetches display data that is supplied one clock after the data-fetch-start-instruction-signal IEI has gone high, by way of example. In other words, the period from the change of the data-fetch-start-instruction-signal IEI up until the fetching of display data by the data latch 100 depends on the configuration of the data latch 100. Essentially, the data latch 100 could be configured to fetch display data that is input after the data-fetch-start-instruction-signal IEI has changed, at data fetch timings having a fetch start timing that is determined by the data-fetch-start-instruction-signal IEI.

Since the fetch timing is dependent on the configuration of this data latch, the controller 50 can provide flexible control over the supply start timing of the display data, generally with reference to the horizontal synchronization signal Hsync. Data corresponding to that supply start timing that is set in the controller 50 can therefore be set in the fetch-start-timing-setting-register 142.

In this manner, the first embodiment of this invention makes it possible to provide a display driver where various types of display can be controlled by the controller that does not output the enable input signal EI. This means it is possible to increase the number of controllers that can be connected to the display driver of this first embodiment. Since it is also possible to dispense with the input terminal for the enable input signal EI, the corresponding wiring to the controller can be omitted, which helps contribute to a reduction in the mounting area.

2.2 Second Embodiment

At least two display drivers in accordance with a second embodiment of this invention can be applied when driving the data lines of an LCD panel.

Figure 9:
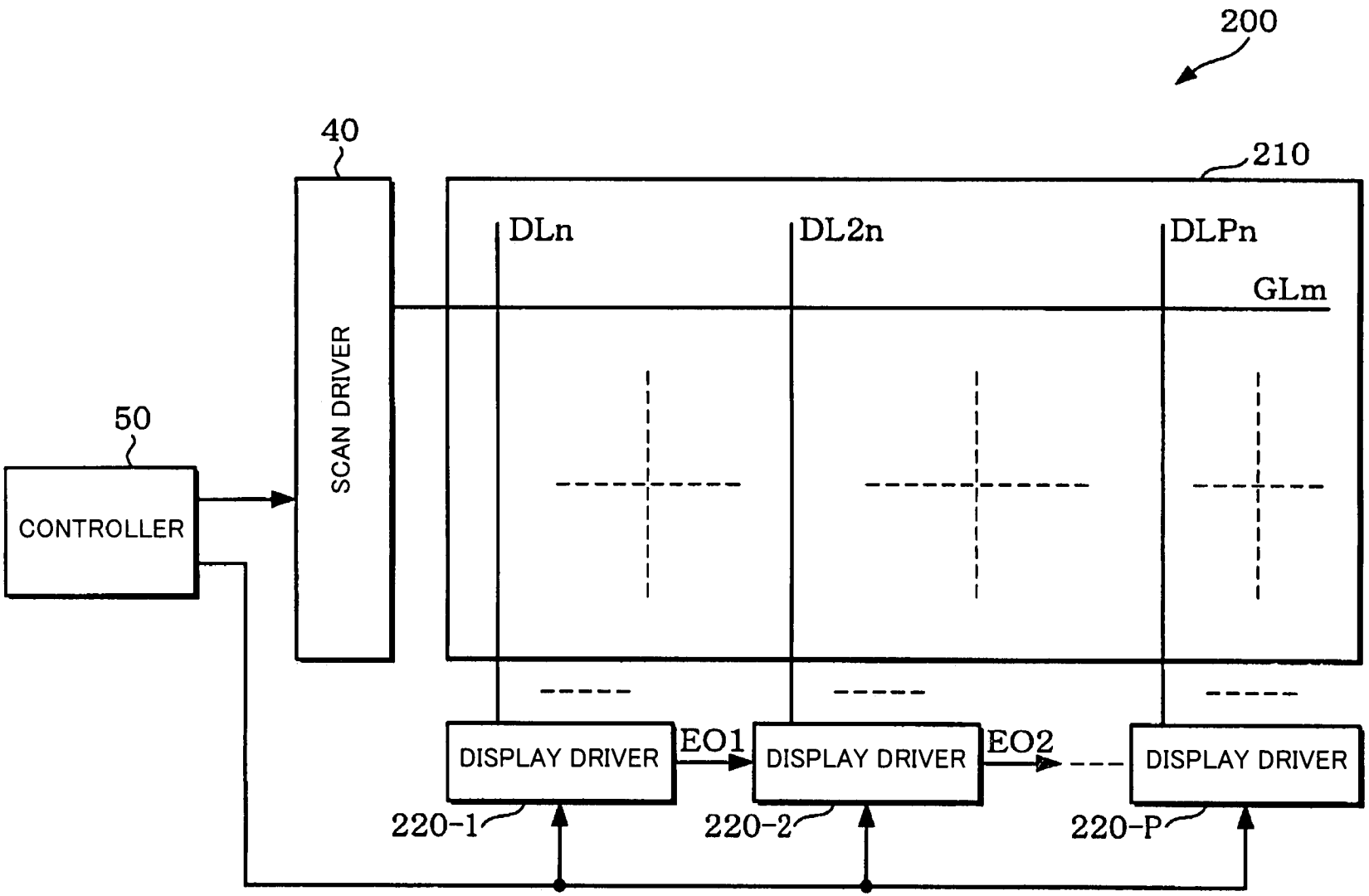
FIG. 9 schematically shows a liquid-crystal device to which a display driver of a second embodiment is applied.

An outline of a liquid-crystal device to which the display driver of the second embodiment is applied is shown in FIG. 9. It should be noted that portions that are the same as those of the liquid-crystal device 10 of FIG. 1 are denoted by the same reference numbers and further description thereof is omitted. Note that the power circuit 60 is omitted from FIG. 9, but a configuration can also be conceived in which the power circuit 60 is included in FIG. 9.

A liquid-crystal device 200 shown in FIG. 9 differs from the liquid-crystal device 10 of FIG. 1 in that an LCD panel 210 of the liquid-crystal device 200 comprises data lines DL1 to DL3N, and in that the data lines DL1 to DL3N of the LCD panel 210 are driven by a plurality of display drivers 220-1 to 220-P (where P is an integer greater than or equal to 2). Note that the display drivers 220-1 to 220-P could be formed on the panel substrate on which the LCD panel 210 is formed, in a similar manner to the liquid-crystal device 10 of FIG. 2.

The display of the display drivers 220-1 to 220-P is controlled by the controller 50. More specifically, the display drivers 220-1 to 220-P fetch display data for one horizontal scan period that is supplied from the controller 50, to drive the data lines DL1 to DL3N of the LCD panel 210, based on drive voltages corresponding to the display data and in mutual synchronization.

The display drivers 220-1 to 220-P are connected in a cascade and each determines the fetch start timing sequentially to the display driver connected to the next stage. Each of the display drivers 220-1 to 220-P sequentially fetches display data on the bus, based on shift outputs that are shifted by the shift register, in a similar manner to the first embodiment. The final-stage shift output of the shift register for the display driver 220-q (where q is an integer such that: $1 \leqq q \leqq P-1$) is output as an enable output signal EOq. That enable output signal EOq is input by the display driver 220-(q+1) that is connecting in the stage after the display driver 220-q. Assume that the display driver 220-(q+1) uses the timing instructed by the enable output signal EOq as the fetch start timing.

To enable the plurality of connected drivers to drive the data lines of the LCD panel 210, the configuration is such that each of the display drivers 220-1 to 220-P can be set to either master mode or slave mode in accordance with the second embodiment.

Figure 10A:
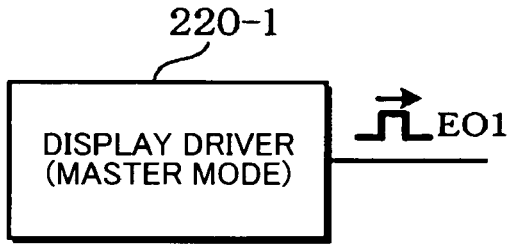
FIG. 10A is a schematic view of a display driver that has been set to master mode.
Figure 10B:
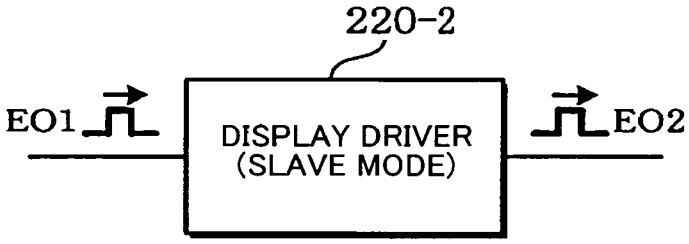
FIG. 10B is a schematic view of a display driver that has been set to slave mode.
Figure 10C:
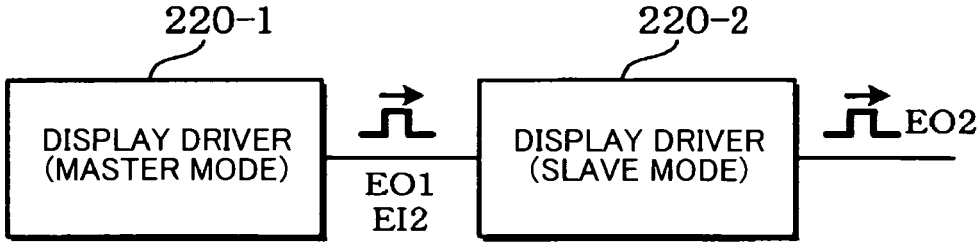
FIG. 10C is a schematic view of the connection between a display driver that has been set to master mode and a display driver that has been set to slave mode.

The operation of each mode of the display drivers of this second embodiment is shown schematically in FIGS. 10A to 10C.

The display driver 220-1 that has been set to master mode internally generates the data-fetch-start-instruction-signal IEI, as shown in FIG. 10A. The display driver 220-1 shifts the data-fetch-start-instruction-signal IEI in the shift register, fetches display data on the bus in accordance with the each stage of shift output, and outputs the final-stage shift output as an enable output signal EO1.

The display driver 220-2 that has been set to slave mode, accepts an enable input signal EI2 from the exterior, as shown in FIG. 10B. In FIG. 9, the display driver 220-2 accepts the enable output signal EO1 that has been output by the display driver 220-1, as the enable input signal EI2. The display driver 220-2 shifts the enable input signal EI2 or a signal corresponding to that enable input signal EI2, fetches display data on the bus on the basis of each stage of shift output, and outputs the final-stage shift output as an enable output signal EO2.

When at least two of these display drivers of the second embodiment are used to drive the LCD panel 210, the display driver 220-1 is set to master mode and the display drivers 220-2 to 220-P are set to slave mode. The display driver 220-1 supplies that enable output signal EO1 to the display driver 220-2 (one of the display drivers that has been set to slave mode) as the enable input signal EI2, as shown in FIG. 10C.

Figure 11:
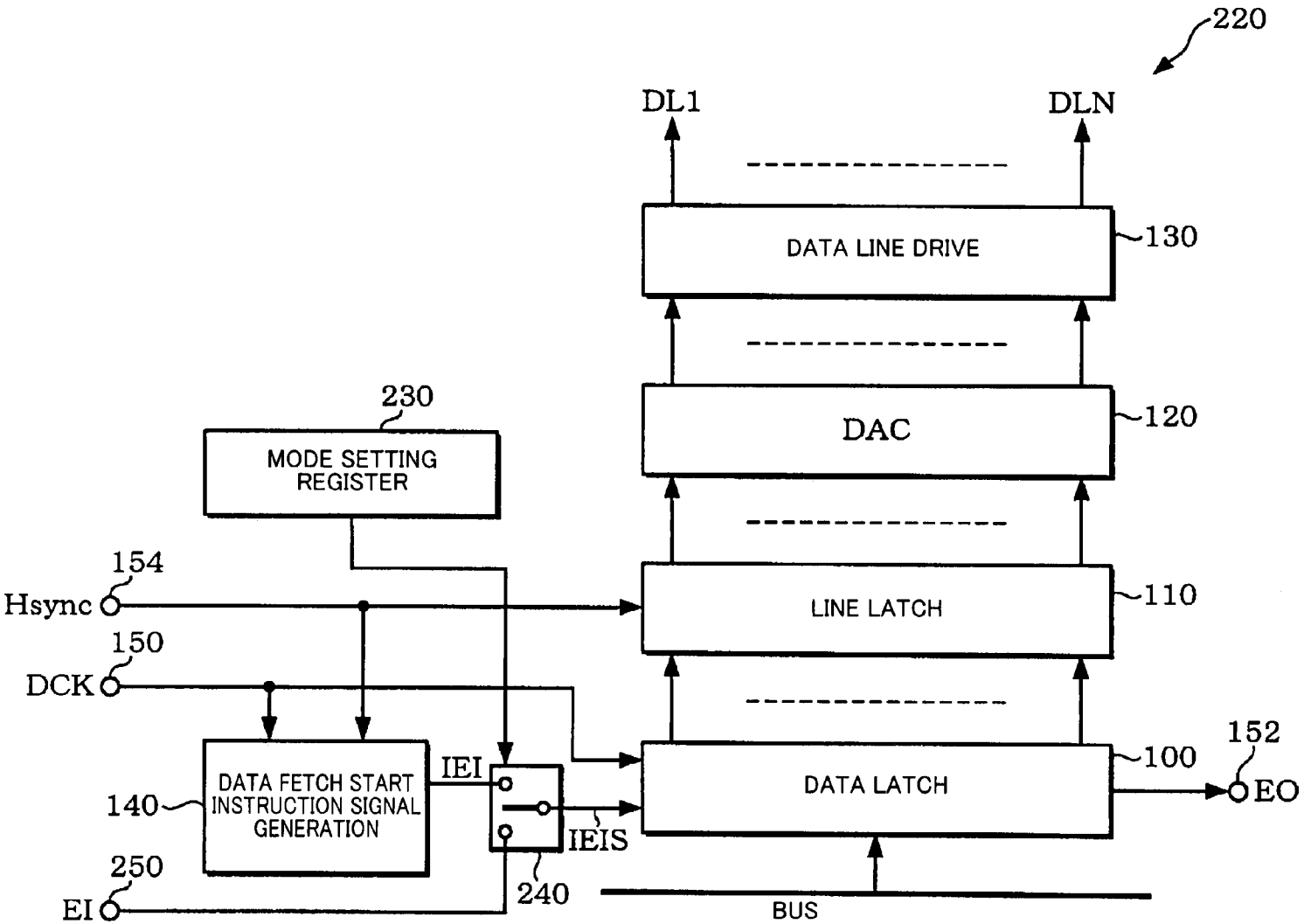
FIG. 11 is a schematic block diagram of the configuration of the display driver of the second embodiment.

A schematic block diagram of the configuration of the display driver 220 in accordance with the second embodiment is shown in FIG. 11. It should be noted that portions that are the same as those of the display driver 30 of FIG. 5 are denoted by the same reference numbers and further description thereof is omitted.

A first point in which the display driver 220 differs from the display driver 30 of FIG. 5 is the provision of a mode setting register 230. The mode setting register 230 is a register that can be set by the host or the like, and is a control register for setting either master mode or slave mode. The display driver 220 is set to master mode or slave mode in accordance with control data that is set in the mode setting register 230 by a command setting from the host (not shown in the figure). For that purpose, a mode setting signal MODE is generated to correspond to control data that has been set in the mode setting register 230. The mode setting signal MODE is output to a switching circuit 240.

A second point in which the display driver 220 differs from the display driver 30 of FIG. 5 is the provision of an enable signal input terminal 250 for inputting the enable input signal EI. The display driver 220 that has been set to slave mode fetches display data on the bus, based on the enable input signal EI that is input through the enable signal input terminal 250.

A third point in which the display driver 220 differs from the display driver 30 of FIG. 5 is the provision of the switching circuit 240.

The switching circuit 240 selectively outputs one of the data-fetch-start-instruction-signal IEI generated by the data-fetch-start-instruction-signal generation circuit 140 or the enable input signal EI that is input through the enable signal input terminal 250 (or a signal corresponding to the enable input signal EI after the enable input signal EI has been subjected to predetermined processing), in accordance with the mode setting signal MODE.

If the display driver 220 has been set to master mode by the mode setting register 230, the switching circuit 240 selects the data-fetch-start-instruction-signal IEI generated by the data-fetch-start-instruction-signal generation circuit 140 and outputs it as a select output signal IEIS. If the display driver 220 has been set to slave mode by the mode setting register 230, the switching circuit 240 selects the enable input signal EI and outputs it as the select output signal IEIS. The shift register 102 of the data latch 100 inputs the select output signal IEIS that has been output from the switching circuit 240 instead of the data-fetch-start-instruction-signal IEI of FIG. 6.

When this display driver 220 has been set to master mode, the operation thereof is similar to that of the first embodiment. When the display driver 220 has been set to slave mode, it can fetch display data at a fetch start timing that is determined by the enable input signal EI that has been input through the enable signal input terminal 250.

3. Other Embodiments

The above embodiments were described with reference to liquid-crystal devices provided with liquid-crystal panels using TFTs, but the present invention is not limited thereto. The above-described voltages could be converted into currents by given current conversion circuits, for supply to current-driven elements. If so, this invention can also be applied to a display driver that drives an organic EL panel comprising organic EL elements provided to correspond to the pixels specified by the data lines and scan lines.

Figure 12:
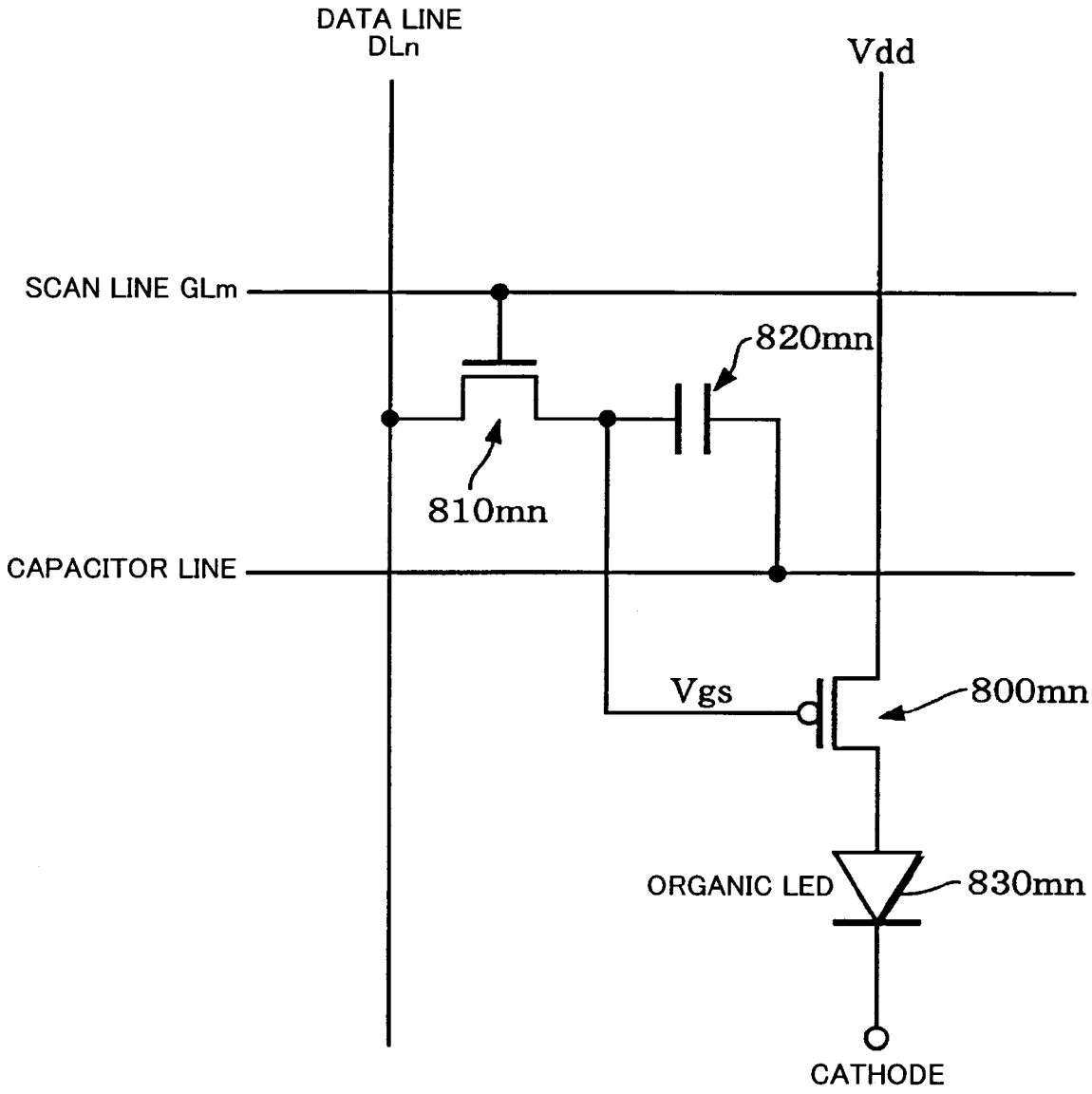
FIG. 12 shows the configuration of an example of a two-transistor pixel circuit in an organic EL panel.

A pixel circuit shown in FIG. 12 is an example of the use of a two-transistor method in an organic EL panel that is driven by such a display driver.

The organic EL panel has a drive TFT 800 nm, a switch TFT 810 nm, a holding capacitor 820 nm, and an organic LED 830 nm at an intersection between the data line DLn and the scan line GLm. The drive TFT 800 nm is configured by a p-type transistor.

The drive TFT 800 nm and the organic LED 830 nm are connected in series with a power line.

The switch TFT 810 nm is inserted between the gate electrode of the drive TFT 800 nm and the data line DLn. The gate electrode of the switch TFT 810 nm is connected to the scan line GLm.

The holding capacitor 820 nm is inserted between the gate electrode of the drive TFT 800 nm and the capacitor line.

In this organic EL element, if the switch TFT 810 nm turns on by driving the scan line GLm, the voltage of the data line DLn is written into the holding capacitor 820 nm and is also applied to the gate electrode of the drive TFT 800 nm. The gate voltage Vgs of the drive TFT 800 nm is determined by the voltage of the data line DLn, which determines the current flowing in the drive TFT 800 nm. Since the drive TFT 800 nm and the organic LED 830 nm are connected in series, the current flowing in the drive TFF 800 nm is unchanged and becomes a current flowing in the organic LED 830 nm.

It is therefore possible to implement a pixel that lights continuously within one frame period, for example, by holding the gate voltage Vgs in accordance with the voltage of the data line DLn by the holding capacitor 820 nm and making the current corresponding to the gate voltage Vgs flow in the organic LED 830 nm.

Figure 13A:
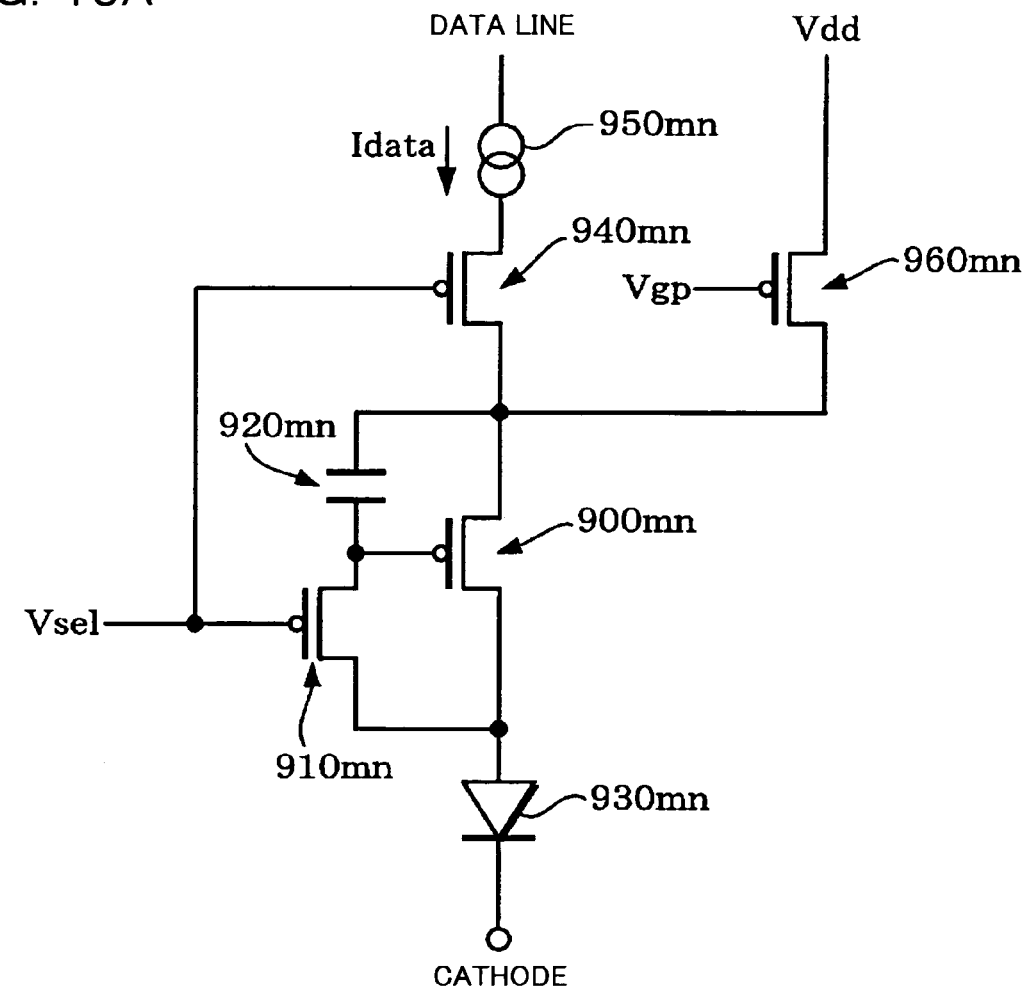
FIG. 13A shows the configuration of an example of a four-transistor pixel circuit in an organic EL panel.
Figure 13B:
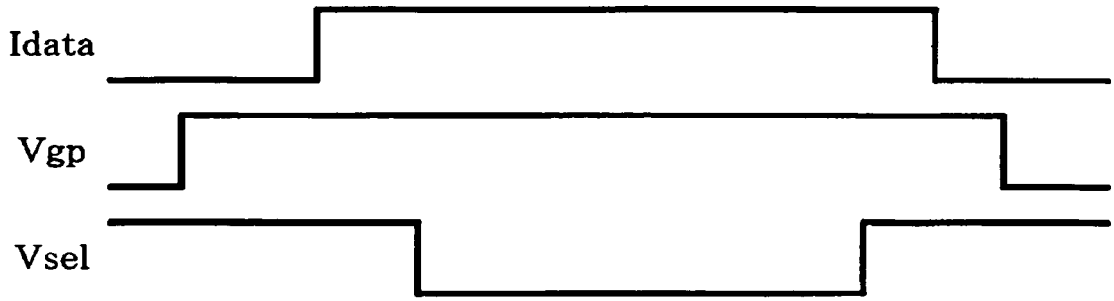
FIG. 13B is a timing chart of an example of display control timing by a pixel circuit.

A pixel circuit shown in FIG. 13A is an example of the use of a four-transistor method in an organic EL panel that is driven by such a display driver. An example of the timing of display control in this pixel circuit is shown in FIG. 13B.

In this case too, the organic EL panel comprises a drive TFT 900 nm, a switch TFT 910 nm, a holding capacitor 920 nm, and an organic LED 930 nm.

This pixel circuit differs from that of the two-transistor method shown in FIG. 12 in that a constant current Idata is supplied from a constant-current source 950 nm to a pixel through a p-type TFT 940 nm that acts as a switching element, instead of a fixed voltage, and the holding capacitor 920 nm and the drive TFT 900 nm are connected to the power line by a p-type TFT 960 nm that acts as a switching element.

In this organic EL element, the power line is first cut off by turning off the p-type TFT 960 nm by a gate voltage Vgp, the p-type TFT 940 nm and the switch TFT 910 nm are turned on by a gate voltage Vsel, and the constant current Idata flows from the constant-current source 950 nm into the drive TFT 900 nm.

A voltage corresponding to the constant current Idata is held in the holding capacitor 920 nm until the current flowing in the drive TFT 900 nm has stabilized.

Next, the p-type TFT 940 nm and the switch TFT 910 nm are turned off by the gate voltage Vsel, and also the p-type TFT 960 nm is turned on by the gate voltage Vgp, so that the power line is connected electrically to the drive TFT 900 nm and the organic LED 930 nm. During this time, the constant current Idata is kept substantially the same by the voltage held in the holding capacitor 920 nm, or a current of an equivalent size is supplied to the organic LED 930 nm.

The organic LED could be provided with a light-emitting layer above a transparent anode (ITO), with a metal cathode provided thereabove; or it could be provided with a light-emitting layer, an optically transmissive cathode, and a transparent seal above a metal anode; but the element configuration is not limited thereto.

It is possible to provide a display driver that can be used in an ordinary manner in an organic EL panel, by configuring the display driver that drives the above-described organic EL panel comprising organic EL elements as described above.

Note that the present invention is not limited to this embodiment and thus various modifications thereto are possible within the scope of the invention laid out herein. The above embodiments were described with reference to an example of a liquid-crystal panel of an active-matrix type where each pixel of the display panel has TFTs, but the present invention is not limited thereto. It can also be applied to a liquid-crystal panel of a passive-matrix method. Furthermore it is not limited to liquid-crystal panels, and it can equally well be applied to plasma display devices, by way of example.

Part of requirements of a claim of the present invention could be omitted from a dependent claim which depends on that claim. Moreover, part of requirements of any independent claim of the present invention could be made to depend on any other independent claim.

The specification discloses the following matters about the configuration of the embodiments described above.

According to one embodiment of the present invention, there is provided a display driver which drives a plurality of data lines of an electro-optical device that includes a plurality of pixels, a plurality of scan lines, and the data lines, the display driver comprising:

an instruction signal generation circuit which generates a data-fetch-start-instruction-signal;

a data latch which fetches display data at data fetch timings including a fetch start timing that is determined by the data-fetch-start-instruction-signal; and a data line drive circuit which drives the data lines, based on the display data fetched into the data latch, wherein the instruction signal generation circuit includes a fetch-start-timing-setting-register into which is set data for determining the fetch start timing of the display data, and wherein the instruction signal generation circuit generates the data-fetch-start-instruction-signal that changes when a period corresponding to the data set in the fetch-start-timing-setting-register has elapsed, with reference to a reference timing.

In this embodiment, in the display driver comprising a fetch-start-timing-setting-register, a data-fetch-start-instruction-signal is generated in such a manner that it changes after the lapse of a period corresponding to the data set in the fetch-start-timing-setting-register, with reference to a given reference timing. In this display driver, the fetch start timing that determines the data fetch timings for fetching display data is determined by the data-fetch-start-instruction-signal. Therefore, the fetch-start-timing-setting-register may be set to match a supply start timing for the display data, with reference to a given reference timing. In such a case, it becomes possible to provide a display driver that enables display control by a controller that does not output an enable input signal, even if no enable input signal is supplied from the controller in synchronization with the display data.

In this display driver, the data for determining the fetch start timing may be data corresponding to a period up until the fetch start timing of the display data, with reference to a transition point in a horizontal synchronization signal that determines one horizontal scan period, and the reference timing may be the transition point in the horizontal synchronization signal.

In this display driver, the data corresponding to the period up until the fetch start timing of the display data may be a number of clocks of a reference clock up until the fetch start timing of the display data, with reference to the transition point in the horizontal synchronization signal, and the display data may be supplied to the data latch in synchronization with the reference clock.

These embodiments make it possible to provide a display driver that can fetch display data, even if no enable input signal is supplied when the supply start timing for the display data is fixed, with reference to a transition point of the horizontal synchronization signal. This enables applications thereof to a wider variety of electro-optical devices.

In this display driver, the instruction signal generation circuit may comprise:

a counter having a count value which is reset based on the horizontal synchronization signal and incremented at a transition point of the reference clock;

a comparator which compares the count value and the data set in the fetch-start-timing-setting-register; and a flip-flop which holds a comparison result signal of the comparator at the transition point of the reference clock, wherein the data-fetch-start-instruction-signal may be a signal that is held in the flip-flop and output to the data latch.

This embodiment makes it possible to provide a display driver of an extremely simple configuration that can fetch display data, even when no enable input signal is supplied.

In this display driver, the data latch may comprise:

a shift register having a plurality of flip-flops, which shifts the data-fetch-start-instruction-signal based on the reference clock, and outputs a shift output from each of the flip-flops; and a latch having a plurality of flip-flops, each of which holds the display data based on the shift output.

This display driver may further comprise:

a mode setting register for setting the display driver into a master mode that is a mode in which the data-fetch-start-instruction-signal is generated by the instruction signal generation circuit or a slave mode that is a mode in which an enable input signal is received from the outside of the display driver; and a switching circuit which outputs the data-fetch-start-instruction-signal or the enable input signal to the data latch, in accordance with the mode set by the mode setting register, wherein the switching circuit may select and output the data-fetch-start-instruction-signal when the display driver is set to the master mode by the mode setting register, and may select and output the enable input signal when the display driver is set to the slave mode by the mode setting register; and wherein the data latch may fetch the display data, based on the output from the switching circuit.

This embodiment makes it possible to provide a display driver that is capable of driving the data lines in a cascade connection, by way of example, and can fetch display data, even when no enable input signal is supplied.

According to another embodiment of the present invention, there is provided an electro-optical device comprising:

a plurality of pixels;

a plurality of scan lines;

a plurality of data lines; and one of the above described display drivers, which drives the data lines.

According to a further embodiment of the present invention, there is provided an electro-optical device comprising:

a display panel including a plurality of pixels, a plurality of scan lines, and a plurality of data lines; and one of the above described display drivers, which drives the data lines.

These embodiments make it possible to provide an electro-optical device that comprises a display driver capable of fetching display data even when no enable input signal is supplied. It is therefore possible to provide an electro-optical device that enables display control by a wider variety of controllers.

According to still another embodiment of the present invention, there is provided an electro-optical device comprising:

a plurality of pixels;

a plurality of scan lines;

a plurality of data lines; and at least two of the above described display drivers, which drives the data lines, wherein one of the at least two display drivers is set to the master mode, wherein the remainder of the at least two display drivers is set to the slave mode, and wherein the display driver that is set to the master mode supplies the enable input signal to at least one of the display drivers that has been set to the slave mode.

According to a still further embodiment of the present invention, there is provided an electro-optical device comprising:

a display panel including a plurality of pixels, a plurality of scan lines, and a plurality of data lines; and at least two of the above described display drivers, which drives the plurality of data lines, wherein one of the at least two display drivers is set to the master mode, wherein the remainder of the at least two display drivers is set to the slave mode, and wherein the display driver that is set to the master mode supplies the enable input signal to at least one of the display drivers that has been set to the slave mode.

With these embodiments, one display driver is set to master mode and the remainder are set to slave mode. One of the display drivers that is set to slave mode is configured to be supplied with an input enable signal from the display driver that is set to master mode. This makes it possible to provide an electro-optical device comprising a plurality of display drivers capable of driving the data lines in a cascade connection, with respect to a number of data lines that cannot be driven by a single display driver. Furthermore, it is possible to provide an electro-optical device that enables display control by a wider variety of controllers, since these display drivers can fetch display data and drive the data lines even when no enable input signal is supplied.

What is claimed is:

1. A driver which drives a plurality of data lines of an electro-optical device that includes a plurality of pixels, a plurality of scan lines, and the data lines, the driver comprising:

an instruction signal generation circuit which generates a data-fetch-start-instruction-signal;

a data latch which fetches display data at data fetch timings including a fetch start timing that is determined by the data-fetch-start-instruction-signal; and a data line drive circuit which drives the data lines, based on the display data fetched into the data latch, wherein the instruction signal generation circuit includes a fetch-start-timing-setting-register into which is set data for determining the fetch start timing of the display data, and wherein the instruction signal generation circuit generates the data-fetch-start-instruction-signal having a voltage that changes when a period corresponding to the data set in the fetch-start-timing-setting-register has elapsed, with reference to a reference timing, the driver further comprising:

a mode setting register for setting the driver into a master mode that is a mode in which the data-fetch-start-instruction-signal is generated by the instruction signal generation circuit or a slave mode that is a mode in which an enable input signal is received from outside of the driver; and a switching circuit which outputs the data-fetch-start-instruction-signal or the enable input signal to the data latch, in accordance with the mode set by the mode setting register, wherein the switching circuit selects and outputs the data-fetch-start-instruction-signal when the driver is set to the master mode by the mode setting register, and selects and outputs the enable input signal when the driver is set to the slave mode by the mode setting register, and wherein the data latch fetches the display data, based on the output from the switching circuit.

2. The driver as defined in claim 1, wherein the data for determining the fetch start timing is data corresponding to a period up until the fetch start timing of the display data, with reference to a transition point in a horizontal synchronization signal that determines one horizontal scan period, and wherein the reference timing is the transition point in the horizontal synchronization signal.

3. The driver as defined in claim 2, wherein the data corresponding to the period up until the fetch start timing of the display data is a number of clocks of a reference clock up until the fetch start timing of the display data, with reference to the transition point in the horizontal synchronization signal, and wherein the display data is supplied to the data latch in synchronization with the reference clock.

4. The driver as defined in claim 3, wherein the instruction signal generation circuit comprises:

a counter having a count value which is reset based on the horizontal synchronization signal and incremented at a transition point of the reference clock;

a comparator which compares the count value and the data set in the fetch-start-timing-setting-register; and a flip-flop which holds a comparison result signal of the comparator at the transition point of the reference clock, wherein the data-fetch-start-instruction-signal is a signal that is held in the flip-flop of the instruction signal generation circuit and output to the data latch.

5. The driver as defined in claim 1, wherein the data latch comprises:

a shift register having a plurality of flip-flops, which shifts the data-fetch-start-instruction-signal based on the reference clock, and outputs a shift output from each of the flip-flops; and a latch having a plurality of flip-flops, each of which holds the display data based on the shift output.

6. The driver as defined in claim 2, wherein the data latch comprises:

a shift register having a plurality of flip-flops, which shifts the data-fetch-start-instruction-signal based on the reference clock, and outputs a shift output from each of the flip-flops; and a latch having a plurality of flip-flops, each of which holds the display data based on the shift output.

7. The driver as defined in claim 3, wherein the data latch comprises:

a shift register having a plurality of flip-flops, which shifts the data-fetch-start-instruction-signal based on the reference clock, and outputs a shift output from each of the flip-flops; and a latch having a plurality of flip-flops, each of which holds the display data based on the shift output.

8. The driver as defined in claim 4, wherein the data latch comprises:

a shift register having a plurality of flip-flops, which shifts the data-fetch-start-instruction-signal based on the reference clock, and outputs a shift output from each of the flip-flops; and a latch having a plurality of flip-flops, each of which holds the display data based on the shift output.

9. An electro-optical device comprising:

a plurality of pixels;

a plurality of scan lines;

a plurality of data lines; and the driver as defined in claim 1, which drives the data lines.

10. An electro-optical device comprising:

a display panel including a plurality of pixels, a plurality of scan lines, and a plurality of data lines; and the driver as defined in claim 1, which drives the data lines.

11. An electro-optical device comprising:

a plurality of pixels;

a plurality of scan lines;

a plurality of data lines; and at least two of the drivers as defined in claim 1, which drives the data lines, wherein one of the at least two drivers is set to the master mode, wherein the remainder of the at least two drivers is set to the slave mode, and wherein the driver that is set to the master mode supplies the enable input signal to at least one of the drivers that has been set to the slave mode.

12. An electro-optical device comprising:

a display panel including a plurality of pixels, a plurality of scan lines, and a plurality of data lines; and at least two of the drivers as defined in claim 1, which drives the plurality of data lines, wherein one of the at least two drivers is set to the master mode, wherein the remainder of the at least two drivers is set to the slave mode, and wherein the driver that is set to the master mode supplies the enable input signal to at least one of the drivers that has been set to the slave mode.

13. A driver comprising:

an instruction signal generation circuit that generates a data-fetch-start-instruction-signal;

a data latch that fetches display data at a timing based on the data-fetch-start-instruction-signal; and a data line drive circuit that outputs first data, the first data being based on the display data, the instruction signal generation circuit including a fetch-start-timing-setting-register and a comparator, the fetch-start-timing-setting-register sets a second data, the second data determines a timing of fetch of the display data by the data latch, the comparator compares the second data and a clock number of a reference clock, the reference clock being supplied to the instruction signal generation circuit.

14. An electro-optical device comprising;

a plurality of pixels;

a plurality of scan lines;

a plurality of data lines; and the driver as defined in claim 13.

* * * * *